US008292479B2

(12) United States Patent
Sazuka et al.

(10) Patent No.: US 8,292,479 B2
(45) Date of Patent: Oct. 23, 2012

(54) VEHICULAR INFRARED IRRADIATION LAMP

(75) Inventors: Kiyoshi Sazuka, Shizuoka (JP); Osamu Masuda, Shizuoka (JP); Hiroya Koizumi, Shizuoka (JP); Takatomo Fujiyoshi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 635 days.

(21) Appl. No.: 12/555,140

(22) Filed: Sep. 8, 2009

(65) Prior Publication Data

US 2010/0060127 A1 Mar. 11, 2010

(30) Foreign Application Priority Data

Sep. 8, 2008 (JP) ..... 2008-230332
Jul. 17, 2009 (JP) ..... 2009-169341

(51) Int. Cl.
*F21V 9/00* (2006.01)

(52) U.S. Cl. ..... 362/511; 362/231; 362/311.02; 362/545; 362/555; 362/547; 362/294; 362/516

(58) Field of Classification Search ..... 362/231, 362/249.02, 294, 311.02, 373, 511, 516, 362/545, 547, 555, 602
See application file for complete search history.

(56) References Cited

U.S. PATENT DOCUMENTS 7,086,767 B2 * 8/2006 Sidwell et al. ..... 362/545
7,134,775 B2 * 11/2006 Oishi et al. ..... 362/545
7,275,839 B2 * 10/2007 Coushaine et al. ..... 362/231
7,993,043 B2 * 8/2011 Sazuka et al. ..... 362/545

FOREIGN PATENT DOCUMENTS

JP 2004-241138 A 8/2004

OTHER PUBLICATIONS

English abstract of JP2004241138 published on Aug. 26, 2004, esp@cenet database, 1 page.

* cited by examiner

*Primary Examiner* — Stephen F Husar
(74) *Attorney, Agent, or Firm* — Osha Liang LLP

(57) ABSTRACT

A vehicular infrared irradiation lamp includes an infrared light-emitting element for projecting infrared light; a visible light-emitting element that emits visible light; and a transparent member provided at least partially adjacent to a light-emitting portion of the infrared light-emitting element. The transparent member radiates visible light received from the visible light-emitting element in a radiation direction of infrared light.

18 Claims, 10 Drawing Sheets

VEHICULAR INFRARED IRRADIATION LAMP

BACKGROUND OF INVENTION

1. Field of the Invention

The present invention relates to a vehicular infrared irradiation lamp, and, more specifically, relates to a structure of a light-emitting element and a reflector in an irradiation lamp.

2. Related Art

A vehicular headlamp apparatus can generally change between a high beam and a low beam. The low beam irradiates the vicinity at a predetermined brightness, and is mainly used for city driving where regulations for light distribution are established so that oncoming and preceding vehicles are not dazzled. Meanwhile, the high beam irradiates a broad range ahead and in the distance at a comparatively high brightness, and is mainly used for high-speed driving on roads with few oncoming or preceding vehicles.

Compared to the low beam, the high beam excels in terms of the driver's visibility. However, the high beam also dazzles the driver of a vehicle (referred to as a preceding vehicle below) traveling in front of the host vehicle. A smart beam system avoids this by including a high/low switch lamp in which a solenoid drives a movable shade to switch between the high beam and the low beam. The smart beam system automatically switches between the high beam and the low beam depending on the conditions around the vehicle. In a vehicle having this smart beam system, an infrared irradiation lamp for determining conditions ahead of the vehicle may be provided in the headlamp. Based on the reflected infrared light projected from the infrared irradiation lamp, the high beam is projected when there is no preceding vehicle and the high beam is automatically switched to the low beam when there is a preceding vehicle present. Thus, the high beam can be selected as often as possible to secure a good field of vision without dazzling preceding vehicles.

When a red light-emitting diode is used as a light source of the infrared irradiation lamp, red visible light may be reflected by a reflector and observed ahead of the lamp. However, installation at the front of the vehicle in this state is not permitted and poses a problem from a legal standpoint. Hence, a vehicular headlamp is described in Patent Document 1 that arranges a semiconductor light-emitting element for visible light and a semiconductor light-emitting element for infrared light in parallel. Both the visible light and infrared light are reflected by a reflector to obscure the redness of the infrared light-emitting element.

[Patent Document 1] Japanese Patent Application Laid-Open (Kokai) No. 2004-241138

SUMMARY OF INVENTION

However, the light radiated from the semiconductor light-emitting element has strong directionality. Therefore, simply arranging the semiconductor light-emitting element for visible light and the semiconductor light-emitting element for infrared light in parallel and near one another according to the art of Patent Document 1 cannot eliminate the redness of the infrared light-emitting element on the entire reflector without difficulty.

One or more embodiments of the present invention obscure the redness of an infrared light-emitting element in a vehicular infrared irradiation lamp that uses the infrared light-emitting element as a light source.

A vehicular infrared irradiation lamp according to one or more embodiments of the present invention includes an infrared light-emitting element for projecting infrared light around a vehicle; a visible light-emitting element that emits visible light; and a transparent member that has a structure provided at least partially adjacent to a light-emitting portion of the infrared light-emitting element, and radiates visible light received from the visible light-emitting element in a radiation direction of infrared light.

According to one or more embodiments, visible light is radiated from the transparent member provided adjacent to the light-emitting portion of the infrared light-emitting element. Therefore, red light emitted from the infrared light-emitting element can be effectively obscured.

The transparent member may be a light guide that has a light receptive portion for receiving visible light from the visible light-emitting element and internally transmits light incident from the light receptive portion. Furthermore, a groove that radiates visible light to outside the light guide may be formed on a surface of the light guide near the light-emitting portion of the infrared light-emitting element. Therefore, a radiation position of visible light inside the light guide can be controlled so as to be set near the infrared light-emitting element.

The vehicular infrared irradiation lamp may further include a reflector that has a curved surface whose focal point is the infrared light-emitting element. In addition, the transparent member may be disposed with a surface thereof inclined with respect to the light-emitting portion of the infrared light-emitting element so as to radiate visible light toward the curved surface portion of the reflector reached by a main portion of light emitted from the infrared light-emitting element. Thus, a region on the reflector where the main portion of red light from the infrared light-emitting element is reflected and a region on the reflector where visible light is reflected are located at the same position. Therefore, the visible light can more effectively eliminate redness.

The vehicular infrared irradiation lamp may further include a heat sink that extends in an optical axis direction of the reflector. In addition, the infrared light-emitting element may be disposed on a surface of the heat sink so as to emit light toward the curved surface of the reflector, while the visible light-emitting element is disposed on a surface different from that with the infrared light-emitting element. In this case, the transparent member may be formed above the light-emitting portions of the infrared light-emitting element and the visible light-emitting element so as to cover both. According to one or more embodiments, one heat sink can be used in common for the infrared light-emitting element and the visible light-emitting element, which can reduce costs.

The infrared light-emitting element and the visible light-emitting element may be arranged adjacent. In such case, the transparent member may be disposed above the light-emitting portions of the infrared light-emitting element and the visible light-emitting element. The transparent member may also have a diffusive member that diffuses light included on the inside or the surface thereof. Thus, red light radiated from the infrared light-emitting element and white light radiated from the visible light-emitting element can be mixed inside the transparent member. Consequently, the redness of the infrared light-emitting element can be obscured.

According to one or more embodiments of the present invention, visible light is radiated from the transparent member provided adjacent to the light-emitting portion of the infrared light-emitting element. Therefore, red light emitted from the infrared light-emitting element can be effectively obscured.

Other aspects and advantages of the invention will be apparent from the following description, the drawings and the claims.

DETAILED DESCRIPTION

Figure 1A:
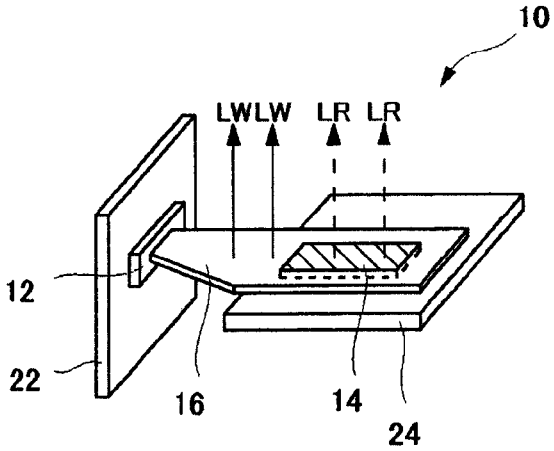
FIG. 1(*a*) is a perspective view that shows an overall configuration of a light source portion of a vehicular infrared irradiation lamp according to a first embodiment, and FIG. 1(*b*) is a top view of the light source portion.

Specific embodiments of the present invention will now be described in detail with reference to the accompanying figures. Like elements in the various figures are denoted by like reference numerals for consistency.

First Embodiment

Figure 1B:
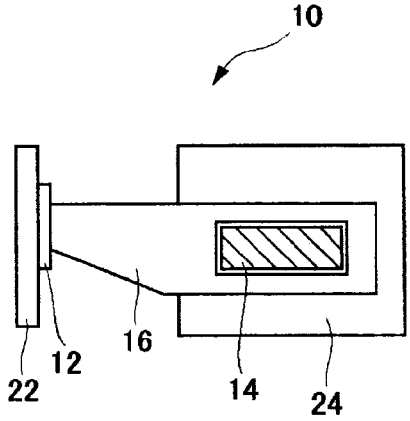

FIG. 1(*a*) is a perspective view that shows an overall configuration of a light source portion 10 of a vehicular infrared irradiation lamp, and FIG. 1(*b*) is a top view of the light source portion 10. The light source portion 10 includes an infrared light-emitting diode 14 that radiates an infrared light LR to a reflector (not shown), and a substrate 24 for the infrared light-emitting diode 14. The infrared light-emitting diode 14 is an oblong chip whose lengthwise portion is perpendicular to an optical axis of the irradiation lamp. When a rectangular chip is used as the light source of infrared light in this manner, infrared light can be broadly irradiated in a vehicle width direction.

A plate-like light guide 16 is placed above the substrate 24 and formed with a hole whose shape encloses the four sides of the infrared light-emitting diode 14. The light guide 16 is formed using a transparent material such as glass or resin. One end of the light guide 16 extends leftward in the figures, and an end portion thereof is positioned adjacent to an upper surface of a white light-emitting diode 12. The white light-emitting diode 12 is placed on a substrate 22.

In the configuration described above, white light LW emitted from the white light-emitting diode 12 is guided from an end portion to inside the light guide and propagated while reflecting off the inside of the light guide 16, such that the white light LW is transmitted to around the infrared light-emitting diode 14. Although not shown in the figures, the surface of a peripheral edge portion of the infrared light-emitting diode 14 among the surface of the light guide 16 is notched with narrow grooves or steps in order to radiate light from inside the light guide to outside. The white light LW inside the light guide 16 leaks from the peripheral edge portion to the reflector. This consequently mixes the white light and red light to obscure the redness when the vehicular infrared irradiation lamp is observed from the front.

The configuration described above enables the emission of white light near and all around the infrared light-emitting diode. Therefore, the color of the red light can be effectively eliminated. Therefore, it is possible to avoid conflict with laws regarding red light emission, even if the infrared irradiation lamp is mounted as a vehicular infrared irradiation lamp for night vision or the like.

In the configuration of FIGS. 1(*a*) and 1(*b*), adopting a light guide 16 that extends out on the same plane as the infrared light-emitting diode 14 allows the white light-emitting diode 12 to be provided perpendicular to the infrared light-emitting diode 14. Therefore, infrared light from the infrared light-emitting diode 14 is not greatly blocked by the substrate 22 of the white light-emitting diode 12.

Second Embodiment

In the configuration of the light source portion 10 shown in FIGS. 1(*a*) and 1(*b*), an amount of white light on a side far from the white light-emitting diode 12 among the light guide 16, namely, an amount of white light that reaches a right end in the figures, is less, as compared to other portions. Consequently, the entire periphery of the infrared light-emitting diode 14 cannot uniformly emit white light.

Figure 2A:
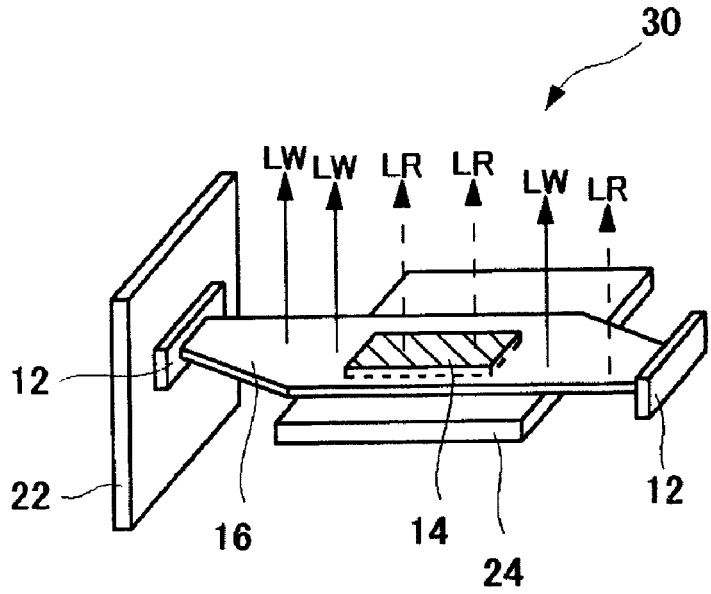
FIG. 2(*a*) is a perspective view that shows an overall configuration of a light source portion of a vehicular infrared irradiation lamp according to a first embodiment, and FIG. 2(*b*) is a top view of the light source portion.
Figure 2B:
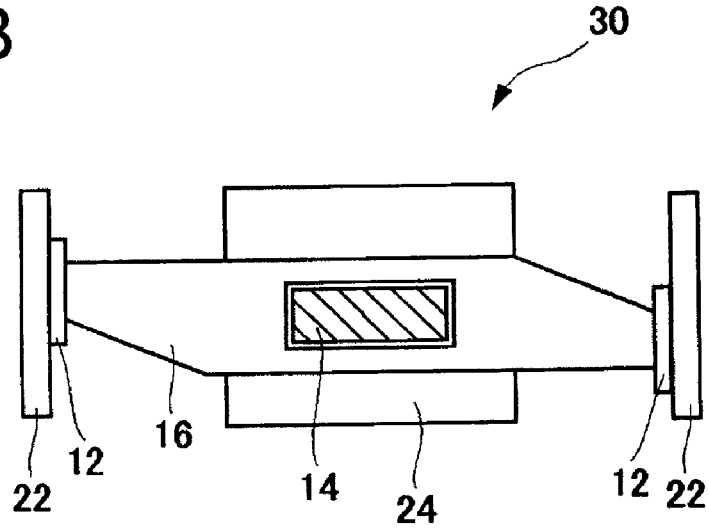

FIG. 2(*a*) is a perspective view that shows an overall configuration of a light source portion 30 of a vehicular infrared irradiation lamp according to a second embodiment, and FIG. 2(*b*) is a top view of the light source portion 30. As shown in the figures, the plate-like light guide 16 is provided formed with a hole whose shape surrounds the four sides of the infrared light-emitting diode 14 similar to the first embodiment. According to the second embodiment, however, in addition to being provided on the left side of the light guide 16, the white light-emitting diode 12 is also provided adjacent to an end portion on the right side. With this configuration, white light from the right and left end portions of the light guide 16 is guided to inside the light guide so that the white light LW leaks from the peripheral edge portion of the infrared light-emitting diode 14. Providing a plurality of white light-emitting diodes enables the periphery of the infrared light-emitting diode to emit light in a more uniform manner, and can heighten the redness elimination effect.

Third Embodiment

Figure 3:
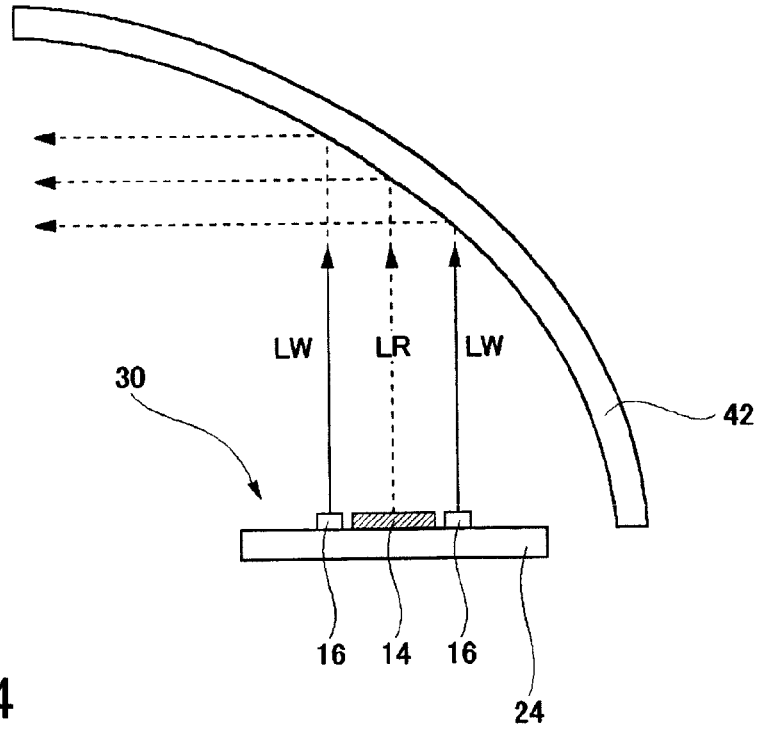
FIG. 3 is a cross-sectional view of an infrared light-emitting diode cut along a plane perpendicular to the lengthwise direction of a light guide of the light source portion.

According to the first and second embodiments, a plate-like light guide is provided formed with a hole whose shape encloses the four sides of an infrared light-emitting diode. FIG. 3 is a cross-sectional view of the infrared light-emitting diode 14 cut along a plane perpendicular to the lengthwise direction of the light guide 16 of the light source portion 30. As shown in the figure, the red light LR is radiated from the infrared light-emitting diode 14 and the white light LW is radiated from the light guide 16 on both sides thereof. FIG. 3 also shows a reflector 42 with a reflective surface that has a generally parabolic curved surface whose focal point is the infrared light-emitting diode 14.

It should be noted that light emitted from a light-emitting diode is generally strongest in a direction perpendicular to the light-emitting surface. Therefore, as shown in FIG. 3, a region on the reflector where the strongest light among the red light LR is reflected and a region on the reflector where the strongest light among the white light LW is reflected are located at different positions. Consequently, the red light and the white light may not mix well on the reflective surface of the reflector and the redness may not be completely eliminated. The brightness of the white light may be increased in order to prevent this, however, this increase will be accompanied by an increased number of white light-emitting diodes and increased power supply.

Figure 4:
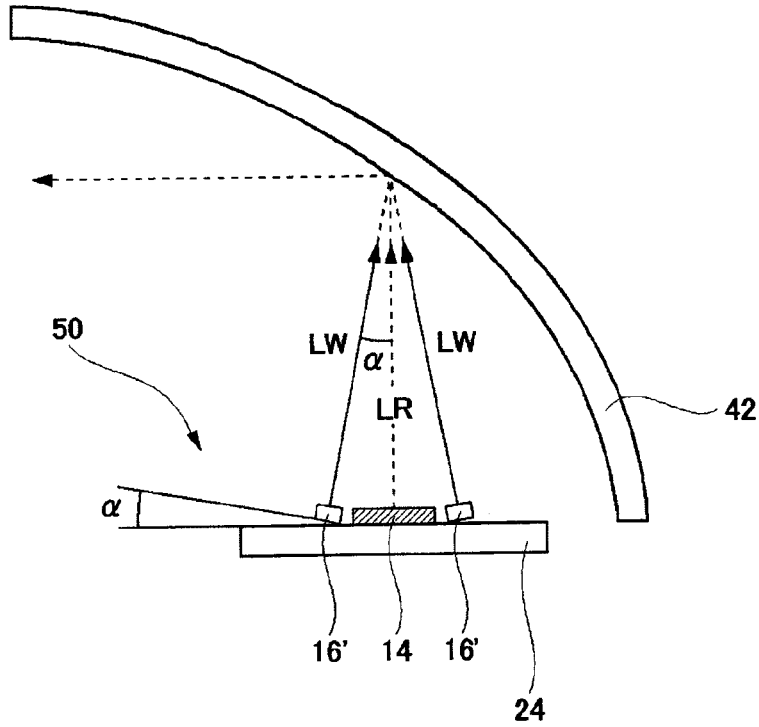
FIG. 4 is a cross-sectional view of the light source portion according to a third embodiment.

Hence, in a third embodiment, the shape of the light guide that surrounds the infrared light-emitting diode is modified. FIG. 4 is a cross-sectional view of a light source portion 50 according to the third embodiment. A light guide 16' is a plate-like light guide formed with a hole whose shape surrounds the four sides of the infrared light-emitting diode 14. However, a portion that sandwiches the infrared light-emitting diode 14 is formed so as to incline inward by an angle $\alpha$. The angle $\alpha$ is equivalent to an angle that is formed by a perpendicular line that extends from the light-emitting surface of the infrared light-emitting diode 14 to the reflective surface of the reflector 42, and a perpendicular line that extends from the surface of the light guide 16' to the reflective surface of the reflector 42.

With such a configuration, as shown in FIG. 4, the region on the reflector where the strongest light among the red light LR is reflected and the region on the reflector where the strongest light among the white light LW is reflected are located at the same position. Therefore, redness elimination by the white light can be achieved to greater effect.

Fourth Embodiment

Figure 5:
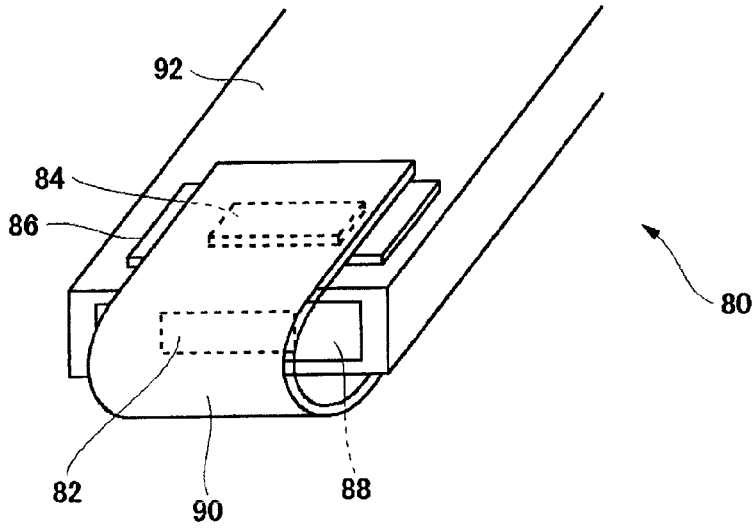
FIG. 5 is a perspective view that shows an overall configuration of the light source portion according to a fourth embodiment.
Figure 6:
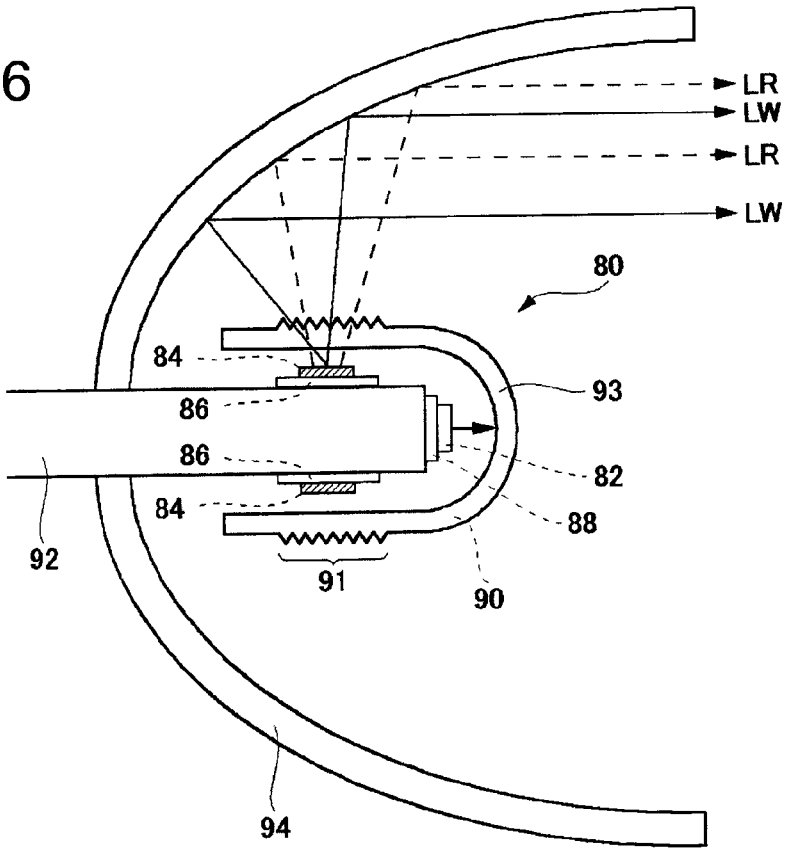
FIG. 6 is a cross-sectional view of the light source portion cut along a horizontal plane that includes an optical axis of the irradiation lamp.

FIGS. 5 and 6 show a light source portion 80 of a vehicular infrared irradiation lamp according to a fourth embodiment, wherein an infrared light-emitting diode 84 and a white light-emitting diode 82 are disposed on the surface of one heat sink. FIG. 5 is a perspective view that shows an overall configuration of the light source portion 80, and FIG. 6 is a cross-sectional view of the light source portion 80 cut along a horizontal plane that includes an optical axis of the irradiation lamp. FIG. 6 also shows a reflector 94 with a generally parabolic curved surface whose focal point is generally positioned on the infrared light-emitting diode 84.

As shown in FIG. 6, a heat sink 92 is a board shaped as a rectangular solid that extends in the optical axis direction of the irradiation lamp, with an end extending to inside the reflector 94 and another end extending to the rear of the irradiation lamp. The infrared light-emitting diode 84 is respectively disposed on both the upper and lower surfaces of the heat sink 92 along with a substrate 86 thereof. One infrared light-emitting diode 82 is disposed on the front end surface of the heat sink 92 along with a substrate 88 thereof.

The light source portion 80 further includes a light guide 90 with an overall U-shaped cross section. As shown in FIG. 5, the width of a portion along the upper and lower surfaces of the heat sink 92 among the light guide 90 is set so as to be slightly longer than the widths of the infrared light-emitting diode 84 and the white light-emitting diode 82. The light guide 90 is fixed above the infrared light-emitting diodes 84 disposed on the upper and lower surfaces of the heat sink 92 so as to cover them. The light guide 90 near the front end portion of the heat sink 92 is curved in a generally semi-circular shape so as to accommodate, on an inner side, the white light-emitting diode 82, which is disposed on the front end portion.

The red light LR radiated from the infrared light-emitting diode 84 passes through the light guide 90 overhead and is reflected by the reflective surface of the reflector 94. White light radiated from the white light-emitting diode 82 is guided to inside the light guide by a light receptive portion 93 with a U-shaped bottom of the light guide 90. The white light LW propagates while reflecting off the inside of the light guide 90, such that the white light LW leaks from steps 91 notched above the infrared light-emitting diode 84 and is reflected by the reflective surface of the reflector 94. This consequently mixes the white light and red light on the reflective surface of the reflector to obscure the redness when the infrared irradiation lamp is observed from the front.

In the configuration according to the fourth embodiment, the infrared light-emitting diode and the white light-emitting diode are easily disposed on the heat sink, which can heighten a heat radiation effect of the light-emitting diodes. The configuration has the further advantage of using one heat sink in common for the infrared light-emitting diode and the white light-emitting diode, which can reduce costs.

Fifth Embodiment

A semiconductor package is conventionally formed mounted with both the infrared light-emitting diode and the white light-emitting diode in order to obscure the redness of the infrared light-emitting diode used as a light source in the vehicular infrared irradiation lamp. However, such a semiconductor package may not adequately eliminate redness, because the infrared light-emitting diode within the semiconductor package may be directly visible when observed from outside the irradiation lamp. A fifth embodiment provides art to solve this problem.

Figure 7:
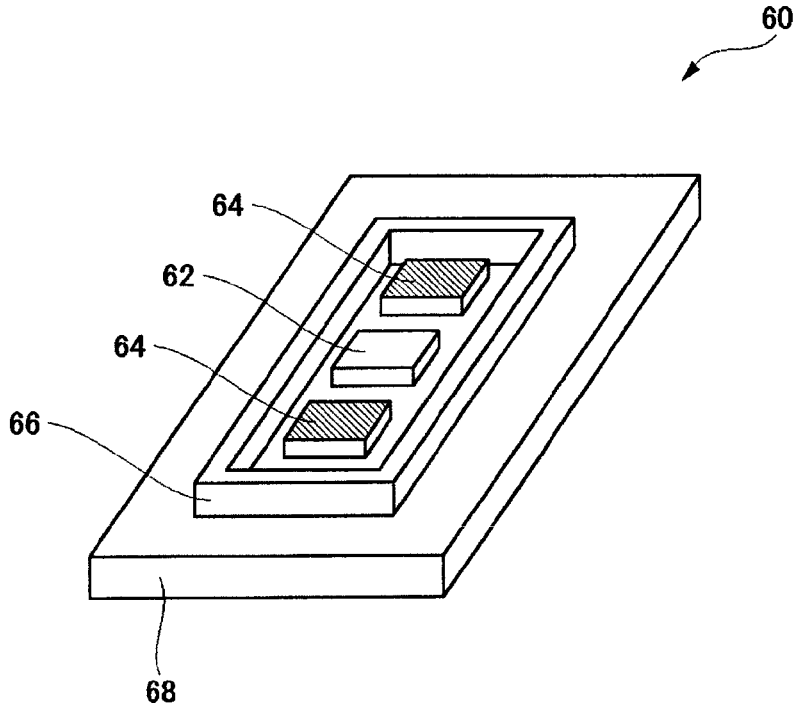
FIG. 7 is a perspective view that shows an overall configuration of a semiconductor package according to a fifth embodiment.

FIG. 7 is a perspective view that shows an overall configuration of a semiconductor package 60 according to the fifth embodiment. In FIG. 7, one white light-emitting diode 62 and two infrared light-emitting diodes 64 are provided on a substrate 68 and enclosed by a surrounding wall 66.

Figure 8:
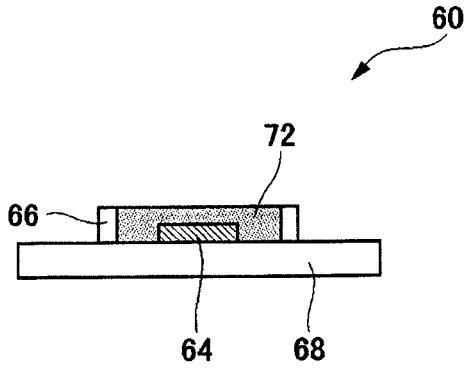
FIG. 8 is a cross-sectional view of the semiconductor package cut along a plane perpendicular to the lengthwise direction.

FIG. 8 is a cross-sectional view of the semiconductor package 60 cut along a plane perpendicular to the lengthwise direction. In this example, resin 72 is embedded inside the surrounding wall 66 in order to seal the light-emitting diodes. Furthermore, a diffusive member that diffuses light is mixed within the resin. The diffusive member may be glass particles, metal powder, or white resin fragments, for example. Thus, red light radiated from the infrared light-emitting diode and white light radiated from the white light-emitting diode are mixed inside the resin 72 by the diffusive member. Accordingly, the redness of the infrared light-emitting diode is obscured even when the package 60 is observed from outside. Note that the diffusive member may be disposed on the surface of the resin.

Figure 9:
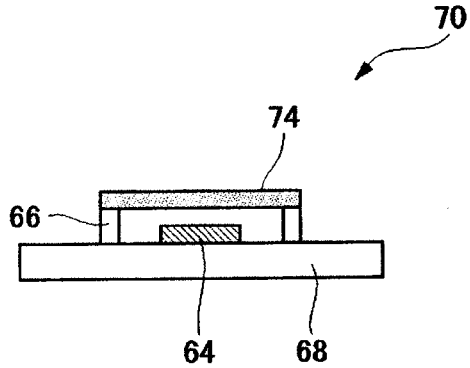
FIG. 9 is a view that shows an example of a protective lens mounted in an upper portion of a surrounding wall in place of resin.

FIG. 9 is a view that shows an example of a protective lens 74 mounted in an upper portion of the surrounding wall 66 in place of the resin 72. The surface of the protective lens 74 is notched with dimples, steps, or the like, for diffusing light. Thus, red light radiated from the infrared light-emitting diode and white light radiated from the white light-emitting diode are mixed upon leaking from the protective lens 74. Accordingly, the redness of the infrared light-emitting diode is obscured even when the package 60 is observed from outside.

Sixth Embodiment

The vehicular infrared irradiation lamp according to the embodiments described above can be used in various applications. Examples include a night vision system for pointing out objects ahead of the vehicle during nighttime travel, and a pre-crash safety system that tightens the seatbelts to help protect occupants when contact with an object is predicted. Installing multiple such systems requires that infrared irradiation lamps provided with different reflectors corresponding to each system are installed in the vehicle, because the irradiation range of infrared light required by each system is different. For example, the night vision system needs an infrared irradiation lamp provided with a condensing reflector, and the pre-crash safety system needs an infrared irradiation lamp provided with a diffusing reflector. Therefore, a bracket is required for fixing the infrared light-emitting diodes serving as light sources to the irradiation lamps.

Figure 10A:
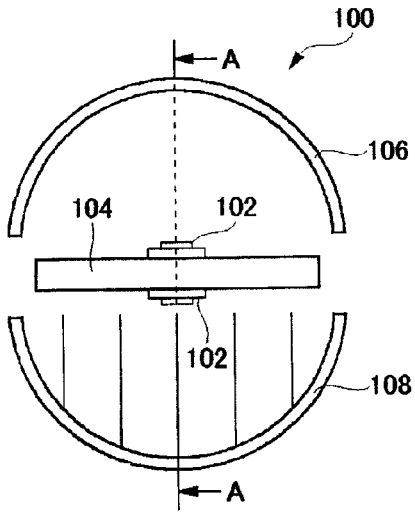
FIG. 10(*a*) is a frontal view that shows an overall configuration of the vehicular infrared irradiation lamp according to a sixth embodiment, and FIG. 10(*b*) is a cross-sectional view taken along a line A-A in FIG. 10(*a*).
Figure 10B:
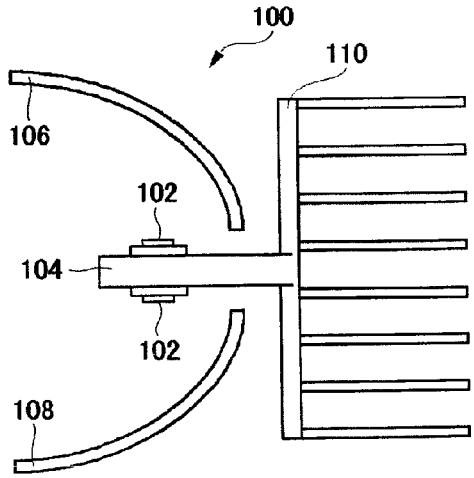

FIG. 10(*a*) is a frontal view that shows an overall configuration of a vehicular infrared irradiation lamp 100 according to a sixth embodiment, and FIG. 10(*b*) is a cross-sectional view taken along a line A-A in FIG. 10(*a*). As shown in the figures, according to the sixth embodiment, a plate-like bracket 104 is disposed along the optical axis of the irradiation lamp 100. An end of the bracket 104 extends to inside the reflector, and another end extends to the rear of the irradiation lamp. Infrared light-emitting diodes 102 for use as light sources are respectively placed on the upper and lower surfaces of the bracket 104. A condensing reflector 106 is arranged on the upper surface side, and a diffusing reflector 108 is arranged on the lower surface side. A heat sink 110 is joined on the rear side of the bracket 104.

Thus, the bracket that fixes the infrared light-emitting diode serving as the light source for the condensing reflector 106 is used in common as the bracket that fixes the infrared light-emitting diode serving as the light source for the diffusing reflector 108. Consequently, the number of components can be reduced.

As explained above, according to one or more embodiments, white light can be irradiated so as to enclose the entire periphery of the infrared light-emitting diode, and, thus, is effective for eliminating the redness of the infrared light-emitting diode. Note that shielding or the like provided within the reflector may be used to ensure that the infrared light-emitting diode itself cannot be directly observed from the front of the vehicular infrared irradiation lamp. Therefore, it is possible to avoid conflict with laws regarding red light emission, even if the infrared irradiation lamp is mounted as a vehicular infrared irradiation lamp for night vision or the like.

Seventh Embodiment

Figure 11:
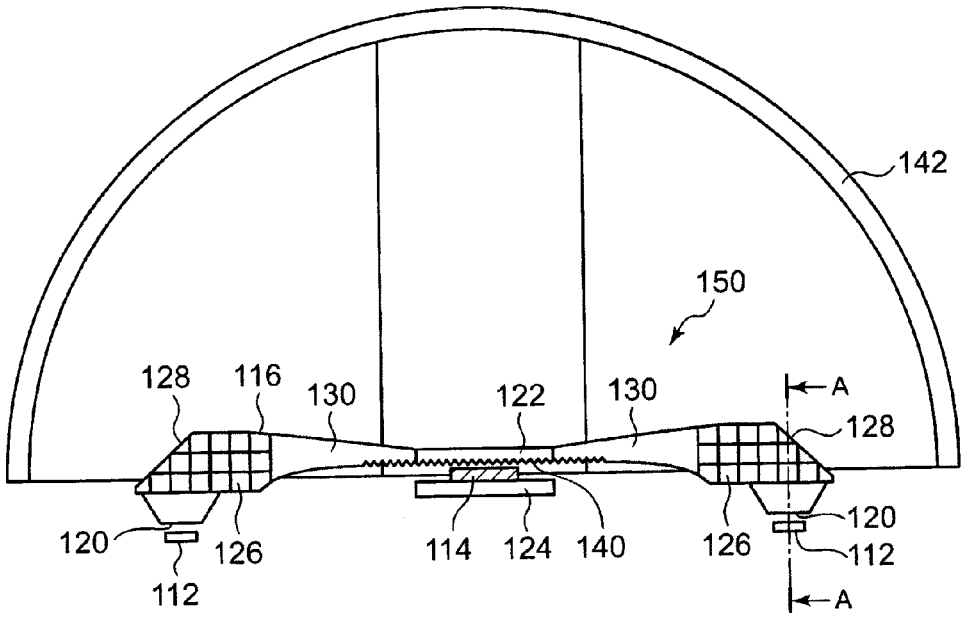
FIG. 11 is a frontal view that shows an overall configuration of the light source portion of a vehicular irradiation lamp according to a seventh embodiment.
Figure 12:
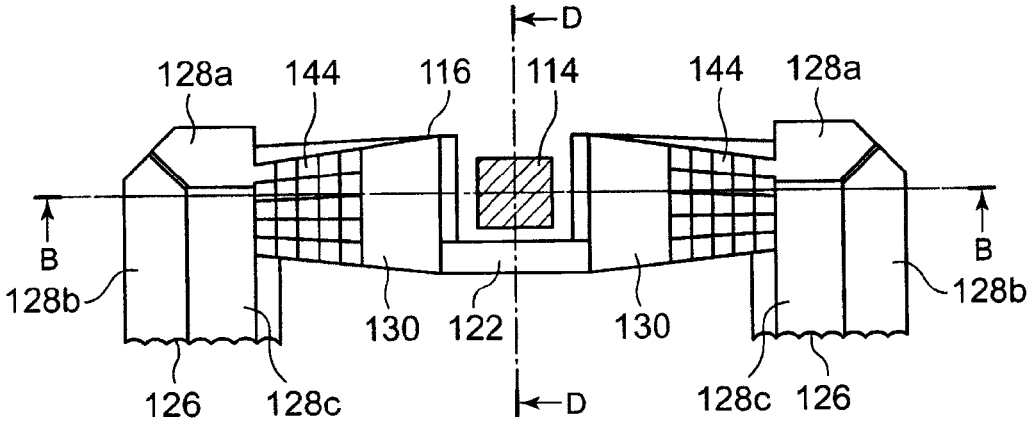
FIG. 12 is a top view of the light source portion in FIG. 11.
Figure 13:
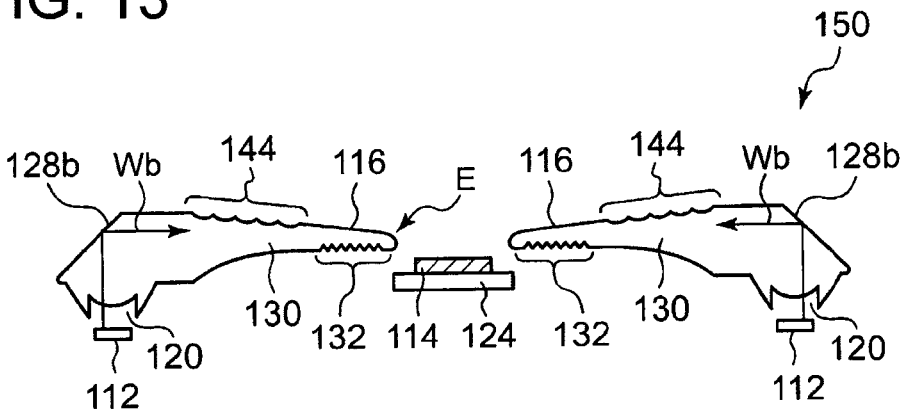
FIG. 13 is a cross-sectional view taken along a line B-B in FIG. 12.
Figure 14:
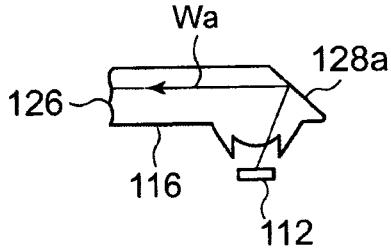
FIG. 14 is a cross-sectional view taken along a line A-A in FIG. 11.

FIGS. 11 to 14 show an overall configuration of a light source portion 150 of a vehicular irradiation lamp according to a seventh embodiment. FIG. 11 is a frontal view of the light source portion 150 as seen from the direction of the vehicle front, FIG. 12 is a top view of the light source portion 150, FIG. 13 is a cross-sectional view taken along a line B-B in FIG. 12, and FIG. 14 is a cross-sectional view taken along a line A-A in FIG. 11. The irradiation lamp of the seventh embodiment functions as an infrared irradiation lamp, and also functions as a vehicle side lamp (clearance lamp) that alerts others to the host vehicle's presence by emitting white light ahead of the vehicle.

The light source portion 150 includes an infrared light-emitting diode 114 that radiates infrared light to a reflector 142, and a substrate 124 for the infrared light-emitting diode 114. Similar to the first embodiment, the infrared light-emitting diode 14 is an oblong chip whose lengthwise portion is perpendicular to an optical axis of the irradiation lamp.

A light guide 116 with an overall general U-shape is disposed above the infrared light-emitting diode 114. The light guide 116 is formed from a transparent material such as glass or resin, and is symmetrically formed about the optical axis of the irradiation lamp. The light guide 116 is formed from a projecting portion 130 having a shape with a thickness that increases toward both right and left sides from the center when viewed from the front; a light receptive portion 120 having a generally trapezoidal shape when viewed from a front surface extending vertically downward; an irradiation control portion 128 that connects the light receptive portion 120 and the projecting portion 130; and a rectangular color elimination portion 122 that connects the right and left projecting portions 130. A white light-emitting diode 112 is disposed at a position facing the right and left light receptive portions 120. Although not shown in the figures, the white light-emitting diode 112 is also disposed on a substrate. As the cross-sectional view in FIG. 13 shows, an inner side of the light receptive portion 120 has a convex shape facing towards the white light-emitting diode 112. White light emitted from the white light-emitting diode 112 is guided to inside the light guide 116 from the light receptive portion 120.

A radiation surface 126 that functions as a vehicle side lamp is formed on the front side of the irradiation control portion 128. A plurality of concave surfaces facing the front side is planarly arranged on the radiation surface 126, and white light is diffused by the concave surfaces.

The irradiation control portion 128 is formed such that white light from the white light-emitting diode 112 is reflected in the two directions of the projecting portion 130 and the radiation surface 126. More specifically, the surface of an upper portion of the irradiation control portion 128 is metallized, whereby white light guided to inside the light guide 116 is reflected without leaking to outside the light guide. As shown in FIG. 12, the upper portion of the irradiation control portion 128 is formed from three flat surfaces 128*a*, 128*b*, 128*c*. As shown in FIG. 14, the flat surface 128*a* is formed inclined at an angle such that white light Wa from the white light-emitting diode 112 heads in the direction of the radiation surface 126. As shown in FIG. 13, the flat surface 128*b* is formed inclined at an angle such that white light Wb from the white light-emitting diode 112 heads in the direction of the projecting portion 130. Thus, use of the radiation control portion 128 having reflective surfaces facing in two different directions enables light from one white light-emitting diode 112 to be distributed in the above two directions.

White light headed toward the radiation surface 126 is diffused by the radiation surface 126 and functions as a vehicle side lamp. White light headed toward the projecting portion 130 propagates while reflecting off the inside of the projecting portion 130, and is transmitted to a distal end E of the projecting portion 130 and the color elimination portion 122 positioned above the infrared light-emitting diode 114. The lower surface of the color elimination portion 122 is notched with V-shaped groove-like steps 140, and these steps radiate white light therein toward the reflector 142. Accordingly, the redness of the infrared light-emitting diode 114 can be obscured.

Contrary to the example shown in FIG. 2, the lower surface of the light guide 116 is arranged so as to be positioned slightly above the upper surface of the infrared light-emitting diode 114 in FIG. 11. This layout design is mainly intended to take into account mass production and eliminate processes such as those for positioning the light guide and diode in cases where, as shown in FIG. 2, the light guide 16 and the infrared light-emitting diode 14 must be placed on the same plane. However, the following problem arises when the infrared light-emitting diode 14 is arranged above the light guide 16, which has a rectangular hole that encloses the four sides of the diode 14.

Figure 15:
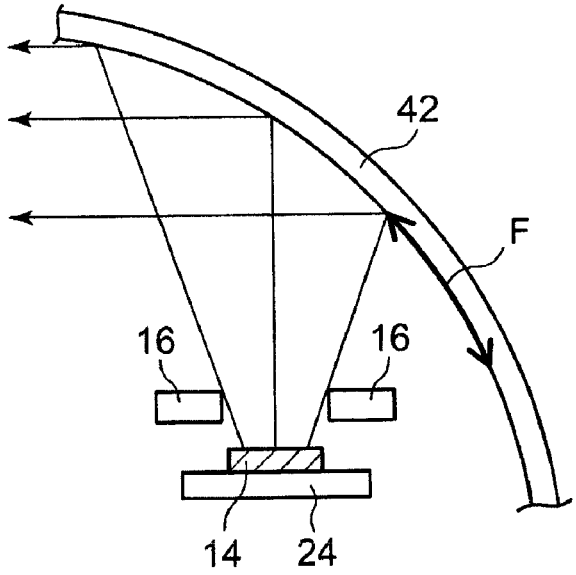
FIG. 15 is a schematic diagram of the light guide disposed above the infrared light-emitting diode shown in FIG. 2.

FIG. 15 is a schematic diagram of the light guide 16 disposed above the infrared light-emitting diode 14 shown in FIG. 2. As the figure shows, a portion of infrared light emitted from the upper surface of the infrared light-emitting diode 14 is blocked in the upper-right direction, namely, by a rectangular light guide portion that is located on the inward side of the reflector 42. Therefore, infrared light does not reach the reflector portion indicated by an arrow F, and the reflector portion F no longer functions to radiate light. This results in reduced performance as an infrared irradiation lamp.

Figure 16:
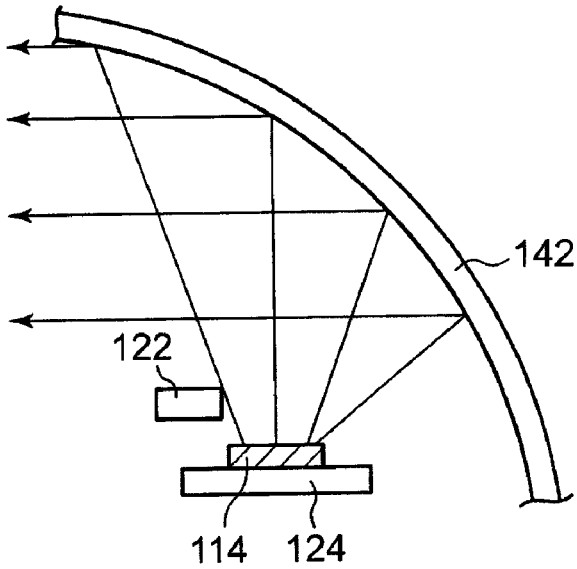
FIG. 16 is a schematic diagram that shows the layout of the light guide and the infrared light-emitting diode according to the seventh embodiment.

Alternatively, FIG. 16 is a schematic diagram that shows the layout of a light guide 116 and a infrared light-emitting diode 114 according to the seventh embodiment, and corresponds to a cross section along a line D-D in FIG. 12. In FIG. 16, the light guide 116 is positioned above the infrared light-emitting diode 114 and consists of only the color elimination portion 122. However, the light guide 116 is not disposed in the right-hand direction over the diode 114, that is, on the inward side of the reflector 142. In other words, a configuration is achieved in which one side is missing among the right and left projecting portions 130 of the light guide 116. Therefore, infrared light radiated from the diode 114 can also reach the reflector portion F.

As explained above, by excluding a portion among the light guide 116 extending from directly over the infrared light-emitting diode 114 to the inward side of the reflector 142 when the light guide 116 is arranged above the diode 114, red light from the infrared light-emitting diode 114 can be mixed with white light from the light guide 116 and obscured, while deterioration in the performance of the infrared irradiation lamp can also be prevented.

Referring to FIG. 11 again, the cross section of the projecting portion 130 of the light guide 116 has a tapered shape that narrows toward the distal end E. White light propagates while reflecting off the inside of the light guide and leaks from the distal end E of the projecting portion 130 and the color elimination portion 122 to the vicinity of the infrared light-emitting diode 114. Furthermore, the lower surface of the projecting portion 130, i.e., the surface on the light-emitting diode 114 side, is notched with V-shaped groove-like steps 132. White light inside the light guide is radiated upward, that is, toward the reflector 142, by the steps 132. Such white light mixes with red light from the infrared light-emitting diode 114 on the reflective surface of the reflector 142, and, thereby, the redness of the infrared light-emitting diode 14 can be more effectively eliminated.

As described above, the irradiation lamp as shown in FIGS. 11 to 14 fulfills the role of a vehicle side lamp that radiates infrared light and emits white light ahead of the vehicle. Accordingly, white light among that guided to inside the light guide from the white light-emitting diode 112 that leaks from the tapered upper surface of the projecting portion 130 and is reflected by the reflector 142 must be kept to below the legal maximum brightness for vehicle side lamps.

Hence, the tapered upper surface, i.e., the surface on the reflector 142 side, of the projecting portion 130 of the light guide 116 is formed with diffusive steps 144 on which a plurality of concavities is planarly arranged. White light leaking from the tapered upper surface of the projecting portion 130 is diffused toward the reflector 142 by the diffusive steps 144. By suitably designing the quantity, shape, and size of the diffusive steps 144, white light leaking from the tapered upper surface of the projecting portion 130 and reflected by the reflector 142 can be kept to below the legal maximum brightness.

At the same time, light among the white light guided to inside the light guide from the white light-emitting diode 112 that leaks from the distal end E of the projecting portion 130 must also be kept to below the legal maximum brightness for vehicle side lamps. However, if the distal end E of the projecting portion 130 has a generally upright shape, for example, white light leaking from the distal end E may reflect off the reflective surface of the reflector 142 and exceed the legal maximum brightness.

Figure 17:
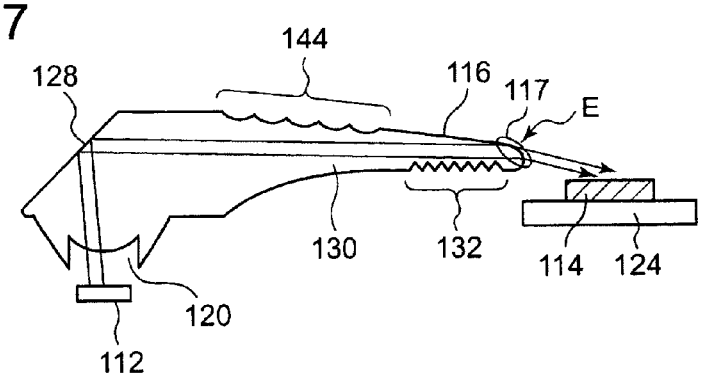
FIG. 17 is an enlarged view of the light guide according to the seventh embodiment.

Hence, in the seventh embodiment, the shape of the distal end E of the projecting portion 130 is modified. FIG. 17 is an enlarged view of a portion of the light guide 116. As shown in the figure, the distal end E of the projecting portion 130 of the light guide has a distal tapered portion 117 formed at an angle such that white light propagating inside the light guide is radiated toward the upper surface of the infrared light-emitting diode 114. Thus, light leaking from the distal end E is no longer directly reflected by the reflector 142 and compliance with the legal maximum brightness for vehicle side lamps can be achieved.

According to the seventh embodiment, white light is guided from the white light-emitting diode 112 disposed on both the right and left sides to inside the light guide 116. Therefore, white light can be emitted at the distal end E of the projecting portion 130 on both the right and left sides of the infrared light-emitting diode 114. Providing a plurality of white light-emitting diodes enables the periphery of the infrared light-emitting diode to emit light in a more uniform manner, and can heighten the redness elimination effect.

Eighth Embodiment

Figure 18:
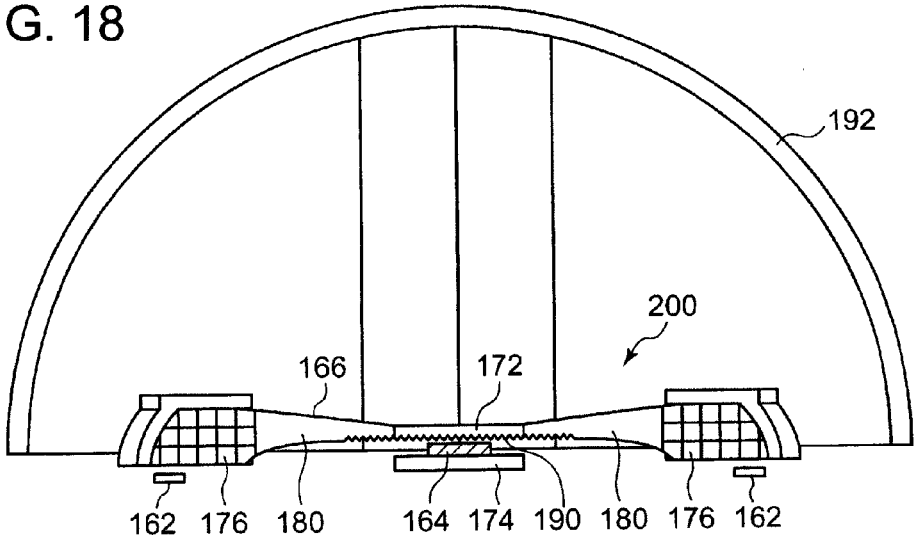
FIG. 18 is a frontal view that shows an overall configuration of the light source portion of the vehicular irradiation lamp according to an eighth embodiment.
Figure 19:
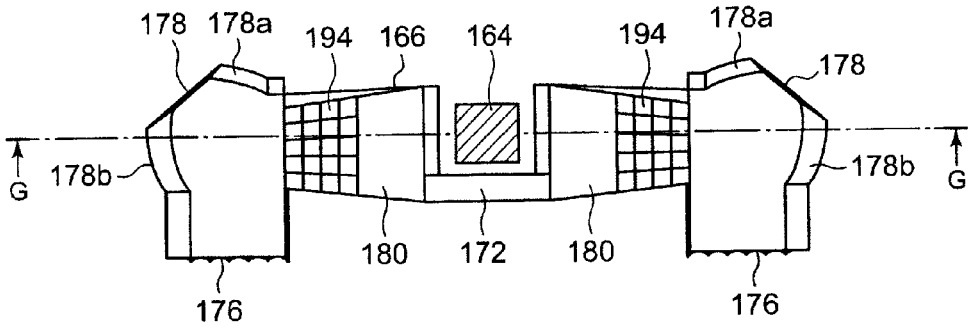
FIG. 19 is a top view of the light source portion in FIG. 18.
Figure 20:
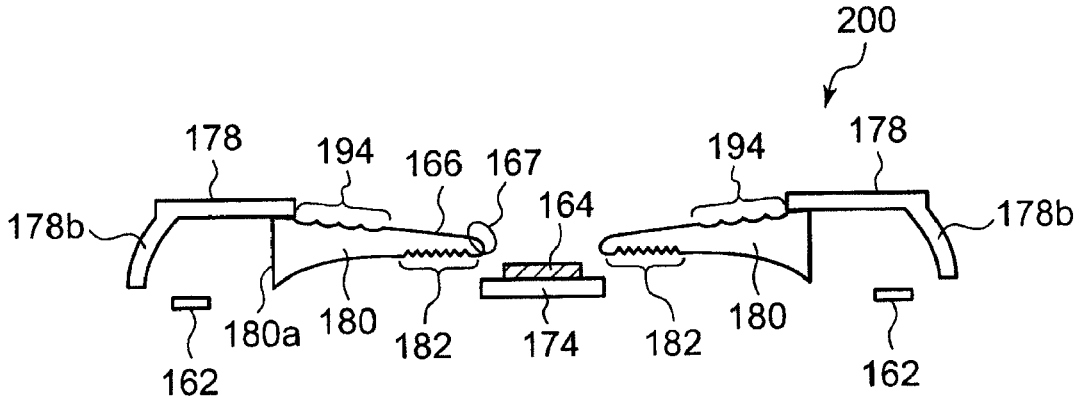
FIG. 20 is a cross-sectional view taken along a line G-G in FIG. 19.

FIGS. 18 to 20 show an overall configuration of a light source portion 200 of a vehicular irradiation lamp according to an eighth embodiment. FIG. 18 is a frontal view of the light source portion 200 as seen from the direction of the vehicle front, FIG. 19 is a top view of the light source portion 200, and FIG. 20 is a cross-sectional view taken along a line G-G in FIG. 12. The irradiation lamp of the eighth embodiment functions as an infrared irradiation lamp, and also functions as a vehicle side lamp that alerts others to the host vehicle's presence by emitting a white light ahead of the vehicle.

The light source portion 200 includes an infrared light-emitting diode 164 that radiates infrared light to a reflector 192, and a substrate 174 for the infrared light-emitting diode 164. A light guide 166 with an overall general U-shape is disposed above the infrared light-emitting diode 164. The light guide 166 is formed from a transparent material such as glass or resin, and has a projecting portion 180 that is symmetrically formed about the optical axis of the irradiation lamp. The projecting portion 180 has a shape whose thickness increases toward both the right and left sides from the center when viewed from the front. The right and left projecting portions 180 are connected by a rectangular color elimination portion 172. In the eighth embodiment as well, the light guide 166 is positioned above the infrared light-emitting diode 164 and consists of only the color elimination portion 172. However, the light guide 166 is not disposed on the inward side of the reflector 192. In other words, a configuration is achieved in which one side is missing among the right and left projecting portions 180 of the light guide 166.

In the light source portion 200 of the eighth embodiment, the shape of the projecting portion 180 among the light guide 166 is identical to that of the seventh embodiment, but differs in the structure of an irradiation control portion 178. As shown in FIG. 20, the inside of the irradiation control portion 178 is hollow, and an opening portion thereof is disposed facing a white light-emitting diode 162. The irradiation control portion 178 is formed from a plurality of sub-reflectors. A portion of white light incident from the white light-emitting diode 162 to inside the irradiation control portion 178 is reflected in the direction of a radiation surface 176, on which a plurality of concavities is planarly arranged, by a sub-reflector 178*a*. Another portion of incident light is reflected in the direction of a bottom surface 180*a* of the projecting portion 180 by another sub-reflector 178*b*.

White light headed toward the radiation surface 176 is diffused by the radiation surface 176 and functions as a vehicle side lamp. White light headed toward the projecting portion 180 propagates while being guided to and reflecting off the inside of the light guide from the bottom surface 180*a*, and is transmitted to the distal end of the projecting portion 180 and the color elimination portion 172 positioned above the infrared light-emitting diode 164. The lower surface of the color elimination portion 172 is notched with V-shaped groove-like steps 190, and these steps radiate white light therein toward the reflector 192. Accordingly, the redness of the infrared light-emitting diode 164 is obscured.

The eighth embodiment is identical to the seventh embodiment in that V-shaped groove-like steps 182 are notched into the lower surface of the projecting portion 180; diffusive steps 194 on which a plurality of concavities is planarly arranged are formed on the tapered upper surface of the projecting portion 180; and a distal tapered portion 167 is provided on the distal end of the projecting portion 180, and formed at an angle such that white light propagating inside the light guide is radiated toward the upper surface of the infrared light-emitting diode 164.

As explained above, even if the irradiation control portion 178 is formed from reflectors, an irradiation lamp can be created having both the functions of an infrared irradiation lamp and a vehicle side lamp. This irradiation lamp makes it possible to avoid conflict with laws regarding red light emission, and suppress white light reflected by the reflectors to below the maximum brightness for vehicle side lamps.

In the above embodiments, a single infrared light-emitting diode is provided as a light source. However, a plurality of infrared light-emitting diodes may be planarly arranged for use as a light source. Likewise, one white light-emitting diode that faces one light receptive portion of the light guide is also provided as a light source. Alternatively, a plurality of white light-emitting diodes may be planarly arranged for use as a light source.

Some of the above embodiments were described as being formed with grooves for radiating light inside the light guide from the surface of the light guide. However, dimples may be provided in place of grooves, or the surface coated with ground glass or subjected to dot printing.

In order to efficiently guide white light from the white light-emitting diode to inside the light guide, the light receptive portion of the light guide that faces the white light-emitting diode may have a hemispherical shape.

The above-described embodiments used a dedicated light-emitting diode as a light source of white light. However, other white light sources such as a clearance lamp may be adopted.

In the above-described embodiments, white light was used for eliminating the redness of the infrared light-emitting diode. However, any color of light may be employed so long as it is visible light.

Embodiments of the present invention may also be applied to a projector type irradiation lamp that uses a reflector with a generally elliptical reflective surface. Furthermore, in addition to being mounted at the front of the vehicle and used as a light source for an infrared night vision device, the infrared irradiation lamp according to one or more embodiments of the present invention may also be mounted at the rear of the vehicle, for example, as a lamp for white line detection.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF THE REFERENCE NUMERALS

10 LIGHT SOURCE PORTION
12 WHITE LIGHT-EMITTING DIODE
14 INFRARED LIGHT-EMITTING DIODE
16 LIGHT GUIDE
22 SUBSTRATE
24 SUBSTRATE
30 LIGHT SOURCE PORTION
42 REFLECTOR
50 LIGHT SOURCE PORTION
60 SEMICONDUCTOR PACKAGE
62 WHITE LIGHT-EMITTING DIODE
64 INFRARED LIGHT-EMITTING DIODE
66 SURROUNDING WALL
68 SUBSTRATE
72 RESIN
74 PROTECTIVE LENS
80 LIGHT SOURCE PORTION
82 WHITE LIGHT-EMITTING DIODE
84 INFRARED LIGHT-EMITTING DIODE
86 SUBSTRATE
90 LIGHT GUIDE
91 STEP
92 HEAT SINK
93 LIGHT RECEPTIVE PORTION
94 REFLECTOR
100 VEHICULAR INFRARED IRRADIATION LAMP
102 INFRARED LIGHT-EMITTING DIODE
104 BRACKET
106 CONDENSING REFLECTOR
108 DIFFUSING REFLECTOR
110 HEAT SINK

What is claimed is:

1. A vehicular infrared irradiation lamp comprising:

an infrared light-emitting element for projecting infrared light;

a visible light-emitting element that emits visible light; and a transparent member provided at least partially adjacent to a light-emitting portion of the infrared light-emitting element, wherein the transparent member radiates visible light received from the visible light-emitting element in a radiation direction of infrared light.

2. The vehicular infrared irradiation lamp according to claim 1, wherein the transparent member is a light guide comprising a light receptive portion for receiving visible light from the visible light-emitting element, wherein the light guide internally transmits light incident from the light receptive portion, and wherein a groove that radiates visible light to outside the light guide is formed on a surface of the light guide near the light-emitting portion of the infrared light-emitting element.

3. The vehicular infrared irradiation lamp according to claim 2, further comprising:

a reflector having a curved surface whose focal point is the infrared light-emitting element, wherein the transparent member is disposed with a surface thereof inclined with respect to the light-emitting portion of the infrared light-emitting element so as to radiate visible light toward the curved surface portion of the reflector reached by a main portion of light emitted from the infrared light-emitting element.

4. The vehicular infrared irradiation lamp according to claim 2, further comprising:

a heat sink extending in an optical axis direction of the reflector, wherein the infrared light-emitting element is disposed on a surface of the heat sink so as to emit light toward the curved surface of the reflector, wherein the visible light-emitting element is disposed on a surface different from that with the infrared light-emitting element, and wherein the transparent member is formed above the light-emitting portions of the infrared light-emitting element and the visible light-emitting element so as to cover both.

5. The vehicular infrared irradiation lamp according to claim 1, wherein the infrared light-emitting element and the visible light-emitting element are arranged adjacent, and wherein the transparent member is disposed above the light-emitting portions of the infrared light-emitting element and the visible light-emitting element, and wherein the transparent member has a diffusive member that diffuses light included on one of an inside and a surface thereof.

6. The vehicular infrared irradiation lamp according to claim 1, wherein the infrared light-emitting element is formed in a rectangular chip.

7. The vehicular infrared irradiation lamp according to claim 6, wherein the transparent member is disposed so as to enclose the four sides of the infrared light-emitting element.

8. The vehicular infrared irradiation lamp according to claim 1, wherein the transparent member is made of glass or resin.

9. The vehicular infrared irradiation lamp according to claim 5, wherein the transparent member is made of resin, and wherein the diffusive member is mixed within the resin.

10. A method of manufacturing a vehicular infrared irradiation lamp comprising:

providing an infrared light-emitting element for projecting infrared light around a vehicle;

providing a visible light-emitting element that emits visible light; and providing a transparent member at least partially adjacent to a light-emitting portion of the infrared light-emitting element, wherein the transparent member radiates visible light received from the visible light-emitting element in a radiation direction of infrared light.

11. The method according to claim 10, wherein the transparent member is a light guide comprising a light receptive portion for receiving visible light from the visible light-emitting element, wherein the light guide internally transmits light incident from the light receptive portion, and wherein a groove that radiates visible light to outside the light guide is formed on a surface of the light guide near the light-emitting portion of the infrared light-emitting element.

12. The method according to claim 11, further comprising:

providing a reflector having a curved surface whose focal point is the infrared light-emitting element, and disposing the transparent member with a surface thereof inclined with respect to the light-emitting portion of the infrared light-emitting element so as to radiate visible light toward the curved surface portion of the reflector reached by a main portion of light emitted from the infrared light-emitting element.

13. The method according to claim 11, further comprising:

providing a heat sink extending in an optical axis direction of the reflector, disposing the infrared light-emitting element on a surface of the heat sink so as to emit light toward the curved surface of the reflector, disposing the visible light-emitting element on a surface different from that with the infrared light-emitting element, and forming the transparent member above the light-emitting portions of the infrared light-emitting element and the visible light-emitting element so as to cover both.

14. The method according to claim 10, further comprising:

arranging the infrared light-emitting element and the visible light-emitting element adjacent, and disposing the transparent member above the light-emitting portions of the infrared light-emitting element and the visible light-emitting element, and including a diffusive member that diffuses light on one of an inside and a surface of the transparent member.

15. The method according to claim 10, further comprising:

forming the infrared light-emitting element in a rectangular chip.

16. The method according to claim 15, further comprising:

disposing the transparent member so as to enclose the four sides of the infrared light-emitting element.

17. The method according to claim 10, wherein the transparent member is made of glass or resin.

18. The method according to claim 14, wherein the transparent member is made of resin, and wherein the diffusive member is mixed within the resin.

* * * * *